US009918358B2

(12) United States Patent
Cho et al.

(10) Patent No.: US 9,918,358 B2
(45) Date of Patent: Mar. 13, 2018

(54) MICROWAVE COOKING DEVICE

(71) Applicants: GUANGDONG MIDEA KITCHEN APPLIANCES MANUFACTURING CO., LTD., Foshan, Guangdong (CN); MIDEA GROUP CO., LTD., Foshan, Guangdong (CN)

(72) Inventors: Jaeman Cho, Guangdong (CN); Qihong Ling, Guangdong (CN); Yongnan Mao, Guangdong (CN); Mingbo An, Guangdong (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 341 days.

(21) Appl. No.: 14/866,162

(22) Filed: Sep. 25, 2015

(65) Prior Publication Data

US 2016/0192445 A1 Jun. 30, 2016

(30) Foreign Application Priority Data

Dec. 30, 2014 (CN) ..... 2014 1 0853783
Dec. 30, 2014 (CN) ..... 2014 2 0866233 U
Dec. 30, 2014 (CN) ..... 2014 2 0868026 U

(51) Int. Cl.
*H05B 6/64* (2006.01)
*F04D 29/28* (2006.01)
*F04D 29/42* (2006.01)

(52) U.S. Cl.
CPC ..... *H05B 6/642* (2013.01); *F04D 29/281* (2013.01); *F04D 29/4213* (2013.01); *F04D 29/4226* (2013.01); *F04D 29/4246* (2013.01)

(58) Field of Classification Search
CPC .... F04D 29/281; F04D 29/413; F04D 29/422; F04D 29/4226; F04D 29/4246; F04D 29/44; H05B 6/642
(Continued)

(56) References Cited

U.S. PATENT DOCUMENTS

2007/0160462 A1 7/2007 Tsang et al.
2011/0110774 A1 5/2011 Horng et al.
2013/0248523 A1 9/2013 Kim

FOREIGN PATENT DOCUMENTS

CN 1752456 A 3/2006
CN 103221747 A 7/2013
(Continued)

OTHER PUBLICATIONS

Chinese Office Action dated Feb. 29, 2016 for Corresponding Chinese Application No. 201410853783.8 filed Dec. 30, 2014.
(Continued)

*Primary Examiner* — Dana Ross
*Assistant Examiner* — Brandon Harvey
(74) *Attorney, Agent, or Firm* — David D. Brush; Westman Champlin & Koehler, P.A.

(57) ABSTRACT

A microwave oven includes a shell defining a cooling air inlet and a cooling air outlet therein; a compartment defining a cavity, nested in the shell and defining an open front end, a receiving space being defined between a rear plate of the compartment and a rear plate of the shell; a first electric member and a second electric member disposed in the receiving space respectively; and a fan disposed in the receiving space, defining a first air inlet, a second air inlet, a first air outlet communicated with the first air inlet to define a first air blowing channel, and a second air outlet communicated with the second air inlet to define a second air blowing channel, the fan being configured to cool the first
(Continued)

electric member via the first air blowing channel and to cool the second electric member via the second air blowing channel.

9 Claims, 10 Drawing Sheets

(58) Field of Classification Search
USPC ..... 219/757
See application file for complete search history.

(56) References Cited

FOREIGN PATENT DOCUMENTS

| | | | |
|---|---|---|---|
| CN | 203906335 | U | 10/2014 |
| CN | 104676677 | A | 6/2015 |
| CN | 204371723 | U | 6/2015 |
| CN | 204438235 | U | 7/2015 |

OTHER PUBLICATIONS

English translation of the Chinese Office Action dated Feb. 29, 2016 for Corresponding Chinese Application No. 201410853783.8 filed Dec. 30, 2014.

English translation of the Chinese Office Action dated Jul. 8, 2016 for Corresponding Chinese Application No. 201410853783.8 filed Dec. 30, 2014.

English translation of the International Written Opinion dated Dec. 31, 2015 for International Application No. PCT/CN2015/090803, filed Sep. 25, 2015.

International Search Report and Written Opinion dated Dec. 31, 2015 for International Application No. PCT/CN2015/090803, filed Sep. 25, 2015.

English translation of the Chinese Office Action dated Jan. 9, 2017 for Corresponding Chinese Application No. 201410853783.8 filed Dec. 30, 2014.

English translation of the Chinese Notice of Decision of Grant dated May 17, 2017 for Corresponding Chinese Application No. 201410853783.8 filed Dec. 30, 2014.

MICROWAVE COOKING DEVICE

CROSS-REFERENCE TO RELATED APPLICATIONS

This application claims priority to and benefits of the following applications:

1) Chinese Patent Application Serial No. 201410853783.8, filed with the State Intellectual Property Office of P. R. China on Dec. 30, 2014;

2) Chinese Patent Application Serial No. 201420868026.3, filed with the State Intellectual Property Office of P. R. China on Dec. 30, 2014;

3) Chinese Patent Application Serial No. 201420866233.5, filed with the State Intellectual Property Office of P. R. China on Dec. 30, 2014.

The entire contents of the above applications are incorporated herein by reference.

FIELD

The present invention relates to the field of household appliances, and more particularly to a microwave oven.

BACKGROUND

When a microwave oven is used, an electric member of the microwave oven will produce a lot of heat. If the electric member is at a high temperature for a long time, the overall performance and life of the microwave oven will be affected. Therefore, how to dissipate heat from the electric member becomes a very important problem. In the microwave oven in the related art, a plurality of electric members are cooled in turn using cold air from the environment, such that the path of a cooling air duct of the microwave oven in the related art is long, it takes a long time to circulate air once, and the effect of cooling the electric members is poor, i.e. the heat dissipation performance of the microwave oven in the related art is poor.

SUMMARY

Embodiments of the present invention seek to solve at least one of the problems existing in the related art to at least some extent. Accordingly, the present invention provides a microwave oven having advantages of good cooling effect and excellent heat dissipation performance.

The microwave oven according to embodiments of the present invention includes a shell defining a cooling air inlet and a cooling air outlet therein; a compartment defining a cavity, nested in the shell and defining an open front end, a receiving space being defined between a rear plate of the compartment and a rear plate of the shell, an air intake duct being formed between a side plate of the shell and a side plate of the compartment and communicated with the cooling air inlet; a first electric member and a second electric member disposed in the receiving space respectively; and a fan disposed in the receiving space, defining a first air inlet, a second air inlet opposite to the first air inlet, a first air outlet communicated with the first air inlet to define a first air blowing channel, and a second air outlet communicated with the second air inlet to define a second air blowing channel, the first air blowing channel being disposed independently of the second air blowing channel, the fan being configured to cool the first electric member via the first air blowing channel and to cool the second electric member via the second air blowing channel.

The microwave oven according to embodiments of the present invention has advantages of good cooling effect and excellent heat dissipation performance.

Furthermore, the microwave oven according to embodiments of the present invention may further have the following additional technical features.

In an embodiment, the fan comprises: a housing defining a receiving chamber therein, and defining the first air inlet, the second air inlet opposite to the first air inlet, the first air outlet and the second air outlet which are communicated with the receiving chamber respectively; a separating plate disposed in the receiving chamber, and having a first surface opposite to the first air inlet and a second surface opposite to the second air inlet; a motor connected with the separating plate, and configured to drive the separating plate to rotate; a plurality of first blades disposed on the first surface of the separating plate and spaced apart from each other in a circumferential direction of the separating plate, and each extending in a direction parallel to a rotation axis of the separating plate; and a plurality of second blades disposed on the second surface of the separating plate and spaced apart from each other in the circumferential direction of the separating plate, and each extending in the direction parallel to the rotation axis of the separating plate.

In an embodiment, the housing comprises: a support defining the second air inlet therein; an inner cap disposed on the support, and defining an anti-collision port therein, the second air outlet being defined between the inner cap and the support; and a cover disposed on at least one of the inner cap and the support, and defining the first air inlet therein, the first air outlet being defined between the cover and the inner cap.

In an embodiment, each first blade has a part inside the first air inlet and a remaining part outside the first air inlet, and each second blade has a part inside the second air inlet and a remaining part outside the second air inlet.

In an embodiment, a first receiving sub chamber is defined between the inner cap and the cover, the plurality of first blades are located in the first receiving sub chamber, a second receiving sub chamber is defined between the inner cap and the support, and the plurality of second blades are located in the second receiving sub chamber.

In an embodiment, the separating plate and the inner cap are located in a same plane, and the separating plate is located in the anti-collision port.

In an embodiment, the support comprises a support body and a first upper flanged edge connected with an upper edge of the support body and defining a third air outlet communicated with the receiving chamber; the inner cap includes an inner cap body, a second upper flanged edge connected with an upper edge of the inner cap body and defining a through hole communicated with the receiving chamber and the third air outlet, a left flanged edge and a right flanged edge, the left flanged edge and the right flanged edge being disposed on the inner cap body and opposite to each other, the second air outlet being defined between the inner cap body, the left flanged edge, the right flanged edge and the support body.

In an embodiment, an opening direction of the first air outlet is perpendicular to that of the second air outlet.

In an embodiment, the housing defines a third air outlet communicated with the receiving chamber, an opening direction of the third air outlet is different from the opening direction of the first air outlet and the opening direction of the second air outlet, the second air inlet is communicated with the third air outlet to define a third air blowing channel, the microwave oven further comprises a third electric member, and the fan is configured to cool the third electric member via the third air blowing channel.

In an embodiment, an opening of the first air outlet faces leftward or rightward, the first electric member is located at a left side or a right side of the first air outlet, an opening of the second air outlet faces downward, the second electric member is located below the second air outlet, an opening of the third air outlet faces upward, and the third electric member is located above the third air outlet.

In an embodiment, the second electric member is disposed on a bottom plate of the shell, a part of a top plate of the compartment is backward extended beyond the rear plate of the compartment, and the third electric member is disposed on the part of the top plate of the compartment.

In an embodiment, a compartment air inlet is formed in the rear plate of the compartment, a compartment air outlet is formed in the compartment, the microwave oven further comprises a front air guiding plate defining an end adjacent to and opposite to the first air outlet, and extending in a direction away from the first air outlet, a first air duct is formed between the front air guiding plate and the rear plate of the compartment and communicated with the compartment air inlet, and a second air duct is formed behind the front air guiding plate and opposite to the first electric member.

In an embodiment, the microwave oven further comprises: a rear air guiding plate defining an end adjacent to the first air outlet, and extending in the direction away from the first air outlet, the second air duct being formed between the front air guiding plate and the rear air guiding plate.

In an embodiment, the front air guiding plate comprises: an air guiding plate body extending in a left-right direction, the first air duct being formed between the air guiding plate body and the rear plate of the compartment; and an arc-shaped plate defining a front end connected with the air guiding plate body, and extending backward from the air guiding plate body, the second air duct being formed between the air guiding plate body, the arc-shaped plate and the rear air guiding plate.

In an embodiment, the compartment air outlet is formed in a top plate of the compartment, the microwave oven further comprises an air guiding shield disposed on the top plate of the compartment, a third air duct is formed between the air guiding shield and the top plate of the compartment and extends in a front-rear direction, and a front part of the third air duct is communicated with the compartment air outlet.

In an embodiment, the cooling air inlet is formed in a bottom plate of the shell, and located between the side plate of the shell and the side plate of the compartment, and the microwave oven further comprises a fourth electric member located between the side plate of the shell and the side plate of the compartment.

In an embodiment, the first electric member is a magnetron, the second electric member is a transformer, the third electric member is a filter board, and the fourth electric member is a high-voltage capacitor.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of embodiments of the present invention will become apparent and more readily appreciated from the following descriptions made with reference to the drawings, in which.

DETAILED DESCRIPTION

Figure 1:
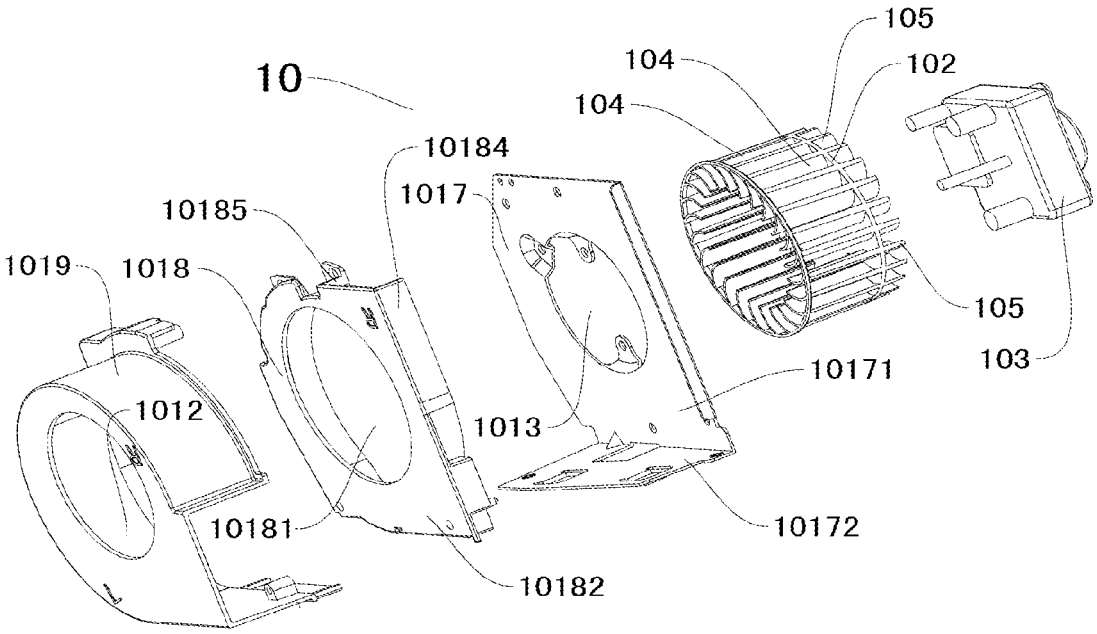
FIG. 1 is an exploded view of a fan according to an embodiment of the present invention.
Figure 2:
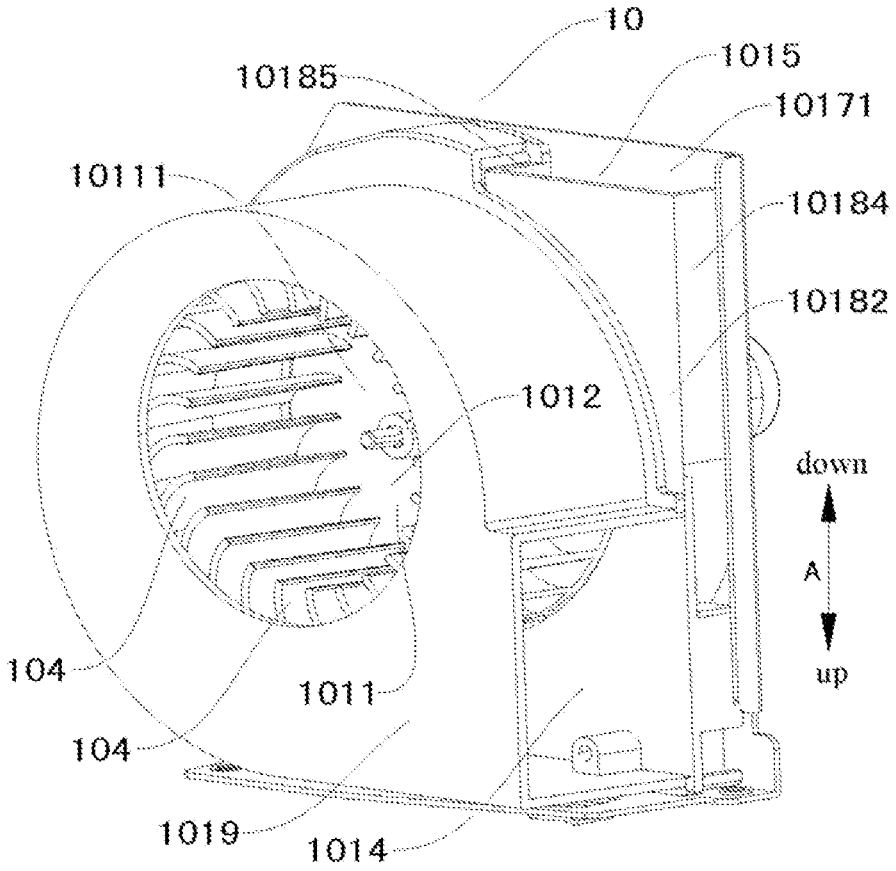
FIG. 2 is a schematic view of a fan according to an embodiment of the present invention.
Figure 3:
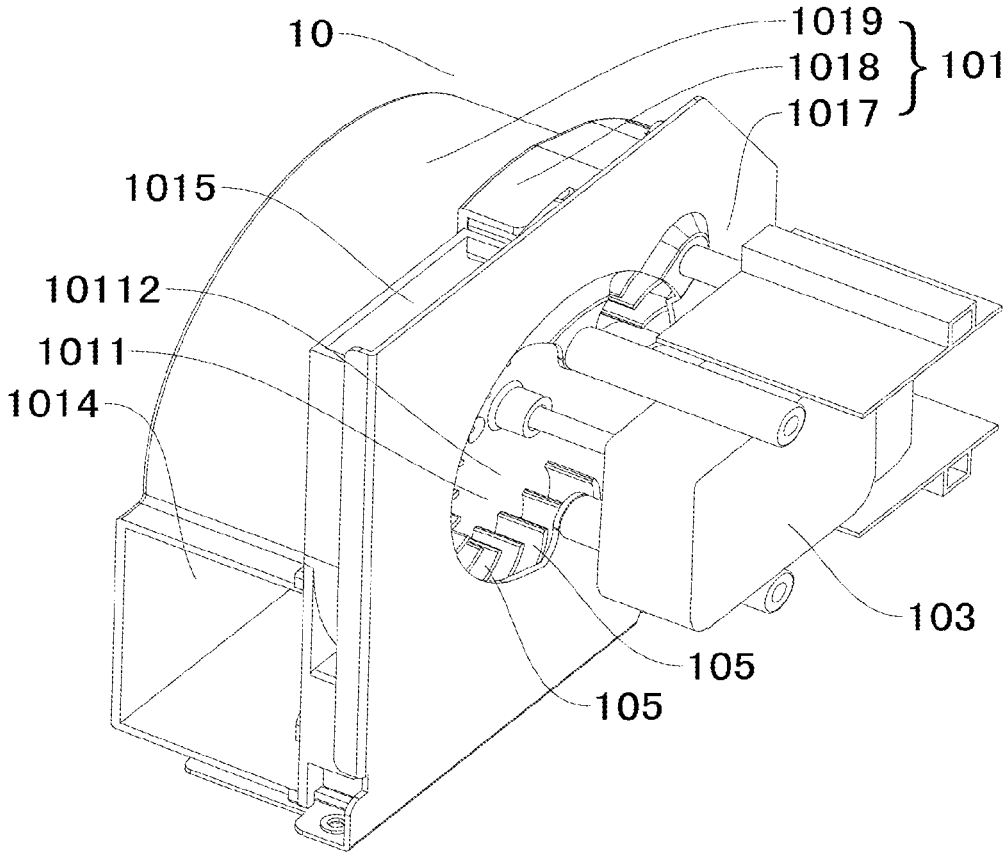
FIG. 3 is a schematic view of a fan according to an embodiment of the present invention.
Figure 4:
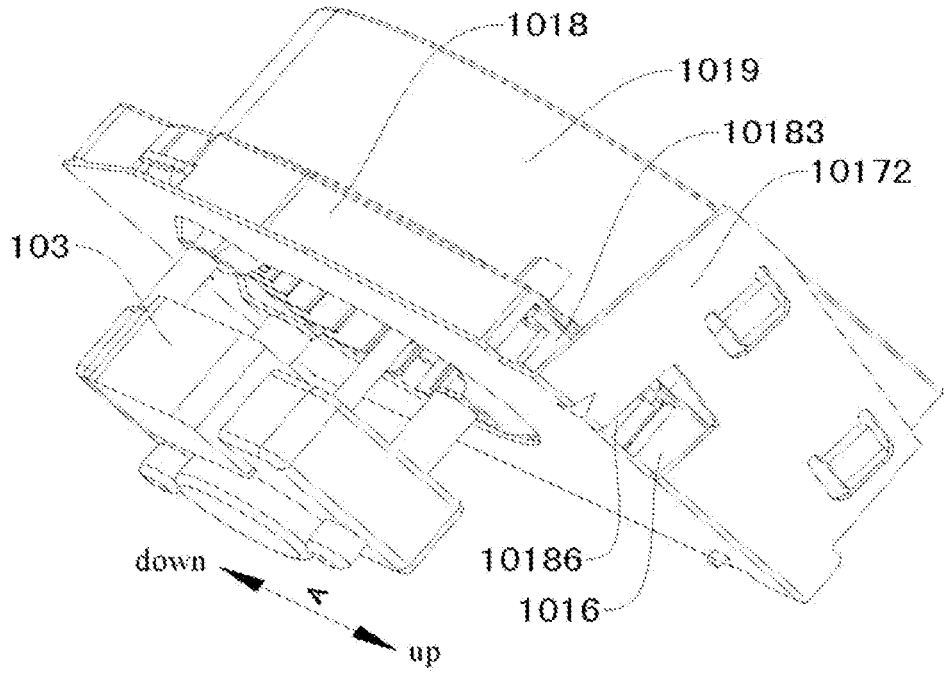
FIG. 4 is a schematic view of a fan according to an embodiment of the present invention.
Figure 5:
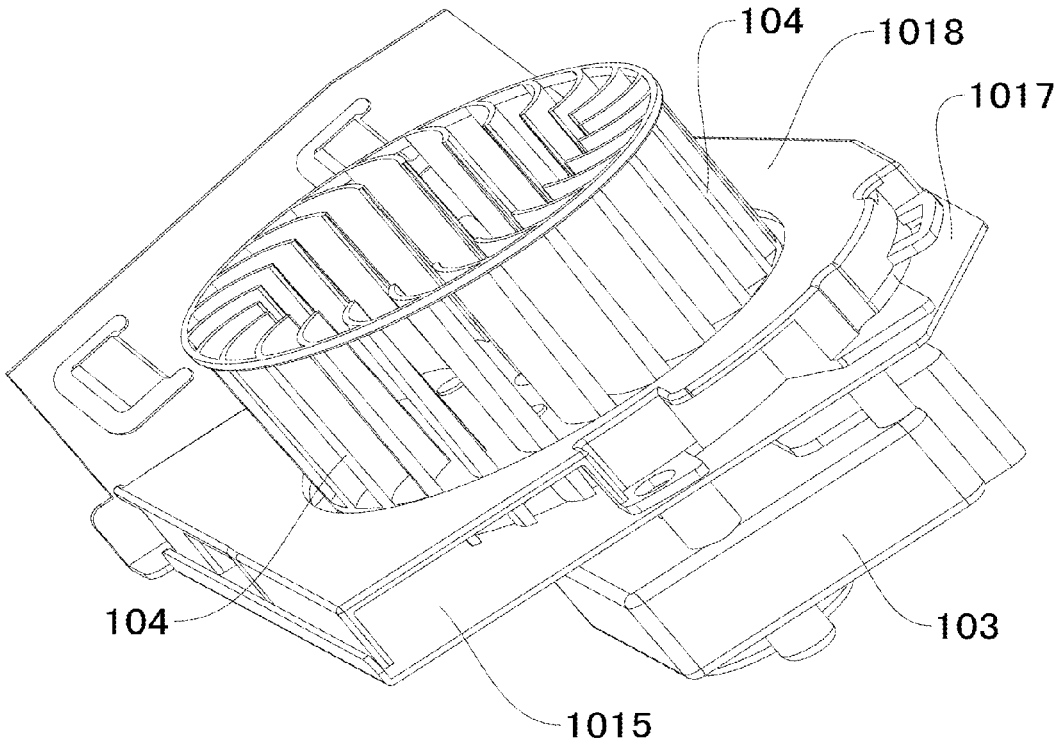
FIG. 5 is a schematic partial view of a fan according to an embodiment of the present invention.
Figure 6:
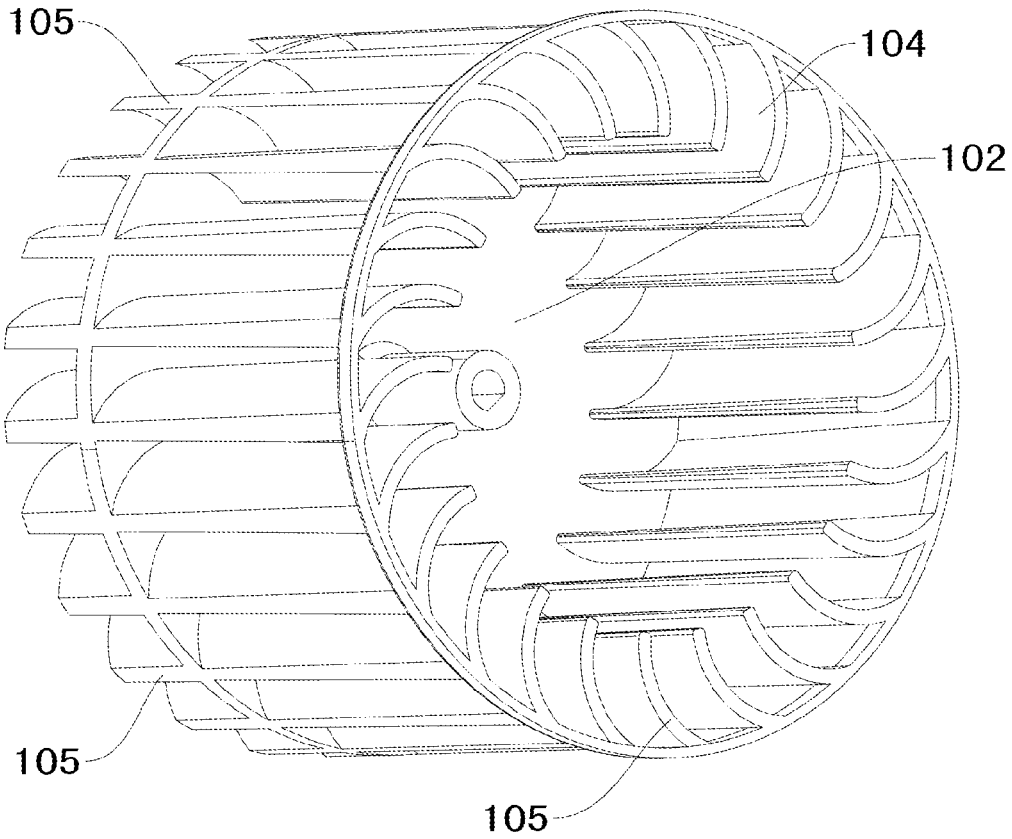
FIG. 6 is a schematic partial view of a fan according to an embodiment of the present invention.

Reference will be made in detail to embodiments of the present invention. The embodiments described herein with reference to drawings are explanatory, illustrative, and used to generally understand the present invention. The embodiments shall not be construed to limit the present invention.

A microwave oven 1 according to an embodiment of the present invention will be described below with reference to the drawings. As shown in FIGS. 1-11, the microwave oven 1 according to an embodiment of the present invention includes a shell 30, a compartment 20, a fan 10, a first electric member 40 and a second electric member 50.

A cooling air inlet 34 and a cooling air outlet are formed in the shell 30. The compartment 20 defines a cavity, is nested in the shell 30 and has an open front end. A receiving space 90 is defined between a rear plate 22 of the compartment 20 and a rear plate of the shell 30. An air intake duct 32 is formed between a side plate (not shown) of the shell 30 and a side plate 23 of the compartment 20 and communicated with the cooling air inlet 34. The first electric member 40 and the second electric member 50 are disposed in the receiving space 90 respectively.

The fan 10 is disposed in the receiving space 90. The fan 10 has a first air inlet 1012, a second air inlet 1013, a first air outlet 1014, and a second air outlet 1015. The first air inlet 1012 is opposite to the second air inlet 1013.

The first air inlet 1012 is communicated with the first air outlet 1014 to define a first air blowing channel 1011. The second air inlet 1013 is communicated with the second air outlet 1015 to define a second air blowing channel (not shown). The first air blowing channel 1011 is disposed independently of the second air blowing channel. The fan 10 is configured to cool the first electric member 40 via the first air blowing channel 1011 and to cool the second electric member 50 via the second air blowing channel.

When a microwave oven is used, an electric member of the microwave oven will produce a lot of heat. If the electric member is at a high temperature for a long time, the overall performance and life of the microwave oven will be affected. Therefore, how to dissipate heat from the electric member becomes a very important problem. In the microwave oven in the related art, a plurality of electric members are cooled in turn using cold air from the environment, such that the path of a cooling air duct of the microwave oven in the related art is long, it takes a long time to circulate air once, and the effect of cooling the electric members is poor, i.e. the heat dissipation performance of the microwave oven in the related art is poor.

In the microwave oven 1 according to embodiments of the present invention, cold air from the environment enters the receiving space 90 via the cooling air inlet 34 in the shell 30. Then, a part of the cold air enters the fan 10 via the first air inlet 1012, and a remaining part of the cold air enters the fan 10 via the second air inlet 1013.

The fan 10 may blow two independent cooling air streams, i.e. the fan 10 may blow cold air from the first air outlet 1014 and the second air outlet 1015 simultaneously. In other words, one cold air stream flows along the first air blowing channel 1011, and the other cold air stream flows along the second air blowing channel. Cold air blown from the first air outlet 1014 is used to cool the first electric member 40, and cold air blown from the second air outlet 1015 is used to cool the second electric member 50. Air passing through the first electric member 40 and the second electric member 50 leaves the microwave oven 1 via the cooling air outlet in the shell 30.

In other words, the fan 10 may be simultaneously used to cool first electric member 40 and the second electric member 50 respectively. That is, the microwave oven 1 according to embodiments of the present invention has a plurality of cooling air ducts, and it is possible to cool the first electric member 40 and the second electric member 50 simultaneously and respectively. Thus, the path of each cooling air duct of the microwave oven 1 may be short, and the time required to circulate air once may be largely reduced, such that the effect of cooling the first electric member 40 and the second electric member 50 may be largely enhanced, and consequently the heat dissipation performance of the microwave oven 1 may be greatly improved. Therefore, the usability of the microwave oven 1 may be largely enhanced, and the life of the microwave oven 1 may be greatly prolonged.

With the microwave oven 1 according to embodiments of the present invention, by providing the fan 10 having the first air blowing channel 1011 and the second air blowing channel, it is possible to cool the first electric member 40 and the second electric member 50 simultaneously and respectively. Moreover, the path of cooling air ducts for cooling first electric member 40 and the second electric member 50 may be greatly shortened, and the time required to circulate air once may be largely shortened, such that the effect of cooling the first electric member 40 and the second electric member 50 may be largely enhanced, and consequently the heat dissipation performance of the microwave oven 1 may be greatly improved. Therefore, the usability of the microwave oven 1 may be largely enhanced, and the life of the microwave oven 1 may be greatly prolonged.

Therefore, the microwave oven 1 according to embodiments of the present invention has advantages of good cooling effect, excellent heat dissipation performance, good usability, long life and so on.

As shown in FIGS. 1-6, the fan 10 includes a housing 101, a separating plate 102, a motor 103 configured to drive the separating plate 102 to rotate, a plurality of first blades 104 and a plurality of second blades 105.

The housing 101 defines a receiving chamber 1011 therein. The first air inlet 1012, the second air inlet 1013 opposite to the first air inlet 1012, the first air outlet 1014 and the second air outlet 1015 are formed in the housing 101 and communicated with the receiving chamber 1011 respectively. The separating plate 102 is disposed in the receiving chamber 1011. A first surface of the separating plate 102 is opposite to the first air inlet 1012, and a second surface of the separating plate 102 is opposite to the second air inlet 1013.

The plurality of first blades 104 are disposed on the first surface of the separating plate 102 and spaced apart from each other in a circumferential direction of the separating plate 102, and each first blade 104 extends in a direction parallel to a rotation axis of the separating plate 102. The plurality of second blades 105 are disposed on the second surface of the separating plate 102 and spaced apart from each other in the circumferential direction of the separating plate 102, and each second blade 105 extends in the direction parallel to the rotation axis of the separating plate 102. The motor 103 is connected with the separating plate 102 to drive the separating plate 102 to rotate, so as to drive the plurality of first blades 104 and the plurality of second blades 105 to rotate.

With the fan 10, by forming the first air outlet 1014 and the second air outlet 1015 in the housing 101, two independent cold air streams may be simultaneously blown, thereby cooling two electric members simultaneously and respectively and thus enhancing the cooling effect.

Therefore, the fan 10 has advantages of good cooling effect and so on.

As shown in FIGS. 1-5, the housing 101 includes a support 1017, an inner cap 1018 and a cover 1019. The second air inlet 1013 and a third air outlet 1016 are formed in the support 1017. The inner cap 1018 is disposed on the support 1017. The second air outlet 1015 is formed between the inner cap 1018 and the support 1017. An anti-collision port 10181 is formed in the inner cap 1018. The cover 1019 is disposed on at least one of the inner cap 1018 and the support 1017, the first air outlet 1014 is formed between the cover 1019 and the inner cap 1018, and the first air inlet 1012 is formed in the cover 1019. Thus, the fan 10 may have a more reasonable structure.

Specifically, the cover 1019 is disposed on the inner cap 1018.

In an embodiment, a first receiving sub chamber 10111 is defined between the inner cap 1018 and the cover 1019, the plurality of first blades 104 are located in the first receiving sub chamber 10111, a second receiving sub chamber 10112 is defined between the inner cap 1018 and the support 1017, and the plurality of second blades 105 are located in the second receiving sub chamber 10112.

The first air inlet 1012 is communicated with the first receiving sub chamber 10111, the second air inlet 1013 is communicated with the second receiving sub chamber 10112, the first air outlet 1014 is communicated with the first receiving sub chamber 10111, and the second air inlet 1013 and the third air outlet 1016 are communicated with the second receiving sub chamber 10112 respectively. In other words, a first sub fan may be constituted by the inner cap 1018, the cover 1019 and the plurality of first blades 104, and a second sub fan may be constituted by the inner cap 1018, the support 1017 and the plurality of second blades 105. Thus, the fan 10 may have a more reasonable structure.

Advantageously, the separating plate 102 and the inner cap 1018 are located in a same plane, and the separating plate 102 is located in the anti-collision port 10181. Thus, the fan 10 may have a more reasonable structure, and the first sub fan and the second sub fan may be prevented from interfering with each other.

The plurality of first blades 104 are disposed on the first surface of the separating plate 102 and spaced apart from each other at equal intervals in the circumferential direction of the separating plate 102, and each first blade 104 has a part inside the first air inlet 1012 and a remaining part outside the first air inlet 1012. The plurality of second blades 105 are disposed on the second surface of the separating plate 102 and spaced apart from each other at equal intervals in the circumferential direction of the separating plate 102, and each second blade 105 has a part inside the second air inlet 1013 and a remaining part outside the second air inlet 1013. Thus, the fan 10 may have a more reasonable structure.

As shown in FIGS. 1-5, the support 1017 includes a support body 10171 and a first upper flanged edge 10172 connected with an upper edge of the support body 10171, and the third air outlet 1016 is formed in the first upper flanged edge 10172. An up-down direction is as indicated by an arrow A in FIGS. 2, 4 and 7.

The inner cap 1018 includes an inner cap body 10182, a second upper flanged edge 10183, a left flanged edge 10184 and a right flanged edge 10185. The second upper flanged edge 10183 is connected with an upper edge of the inner cap body 10182, and a through hole 10186 is formed in the second upper flanged edge 10183 and communicated with the receiving chamber 1011 and the third air outlet 1016. In other words, cold air passes through the through hole 10186 and the third air outlet 1016 in turn.

The left flanged edge 10184 and the right flanged edge 10185 are disposed on the inner cap body 10182 and opposite to each other, and the second air outlet 1015 is defined between the inner cap body 10182, the left flanged edge 10184, the right flanged edge 10185 and the support body 10171. Thus, the fan 10 may have a more reasonable structure.

As shown in FIGS. 1-11, the microwave oven 1 according to some embodiments of the present invention includes a shell 30, a compartment 20, a fan 10, a first electric member 40, a second electric member 50 and a third electric member 60.

As shown in FIGS. 1-6, the fan 10 has a first air inlet 1012, a second air inlet 1013, a first air outlet 1014, a second air outlet 1015, and a third air outlet 1016.

The first air inlet 1012 is opposite to the second air inlet 1013. An opening direction of the third air outlet 1016 is different from an opening direction of the first air outlet 1014 and an opening direction of the second air outlet 1015. In other words, the flowing direction of cold air blown from the third air outlet 1016 is different from the flowing direction of cold air blown from the first air outlet 1014 and the flowing direction of cold air blown from the second air outlet 1015. The third air outlet 1016 may be formed in the housing 101, and communicated with the receiving chamber 1011.

The first air inlet 1012 is communicated with the first air outlet 1014 to define a first air blowing channel 1011. The second air inlet 1013 is communicated with the second air outlet 1015 to define a second air blowing channel (not shown). The first air blowing channel 1011 is disposed independently of the second air blowing channel. The second air inlet 1013 is communicated with the third air outlet 1016 to define a third air blowing channel (not shown).

The fan 10 is configured to cool the first electric member 40 via the first air blowing channel 1011, to cool the second electric member 50 via the second air blowing channel, and to cool the third electric member 60 via the third air blowing channel.

In other words, cold air blown from the third air outlet 1016 is used to cool the third electric member 60. That is, the fan 10 may blow three independent cooling air streams, and thus it is possible to cool the first electric member 40, the second electric member 50 and the third electric member 60 simultaneously and respectively. Thus, the path of each cooling air duct of the microwave oven 1 may be short, and the time required to circulate air once may be largely reduced, such that the effect of cooling the first electric member 40, the second electric member 50 and the third electric member 60 may be largely enhanced, and consequently the heat dissipation performance of the microwave oven 1 may be greatly improved. Therefore, the usability of the microwave oven 1 may be largely enhanced, and the life of the microwave oven 1 may be greatly prolonged.

With the microwave oven 1 according to embodiments of the present invention, it is possible to dissipate heat from the first electric member 40, the second electric member 50 and the third electric member 60 in a three-dimensional way, thus enhancing the performance of a heat dissipation system of the microwave oven 1. On the premise that relevant devices are not added, it is possible to reduce the temperature of the first electric member 40, the second electric member 50 and the third electric member 60 effectively, thus enhancing the usability of the microwave oven 1 and prolonging the life of the microwave oven 1.

Advantageously, a first cold air channel is formed between a rear plate 22 of the compartment 20 and a front surface of the fan 10 and communicated with the air intake duct 32 and the first air inlet 1012, and a second cold air channel is formed between a rear surface of the fan 10 and a rear plate (not shown) of the shell 30 and communicated with the air intake duct 32 and the second air inlet 1013.

The receiving space 90 has a first cooling air duct communicated with the first air outlet 1014, a second cooling air duct communicated with the second air outlet 1015, and a third cooling air duct communicated with the third air outlet 1016. The fan 10 is configured to cool the first electric member 40 via the first cooling air duct, to cool the second electric member 50 via the second cooling air duct, and to cool the third electric member 60 via the third cooling air duct.

In some embodiments, the first electric member 40 is a magnetron, the second electric member 50 is a transformer, and the third electric member 60 is a filter board.

Advantageously, an opening direction of the first air outlet 1014 is perpendicular to that of the second air outlet 1015.

In a specific example, an opening of the first air outlet 1014 faces leftward or rightward, an opening of the second air outlet 1015 faces downward, and an opening of the third air outlet 1016 faces upward. In other words, cold air blown from the first air outlet 1014 flows leftward or rightward, cold air blown from the second air outlet 1015 flows downward, and cold air blown from the third air outlet 1016 flows upward.

The first electric member 40 is located at a left side or a right side of the first air outlet 1014. When the opening of the first air outlet 1014 faces leftward, the first electric member 40 is located at the left side of the first air outlet 1014. When the opening of the first air outlet 1014 faces rightward, the first electric member 40 is located at the right side of the first air outlet 1014. The second electric member 50 is located below the second air outlet 1015, and the third electric member 60 is located above the third air outlet 1016.

Specifically, the first electric member 40 may be disposed on the rear plate of the shell 30, and the second electric member 50 may be disposed on a bottom plate 31 of the shell 30. A part of a top plate 21 of the compartment 20 is backward extended beyond the rear plate 22 of the compartment 20, i.e. the part of the top plate 21 of the compartment 20 is located behind the rear plate 22 of the compartment 20, and the third electric member 60 is disposed on an upper surface of the part of the top plate 21 of the compartment 20. In other words, an air vent through which cold air passes is formed in the part of the top plate 21 of the compartment 20, and opposite to the third electric member 60.

Figure 7:
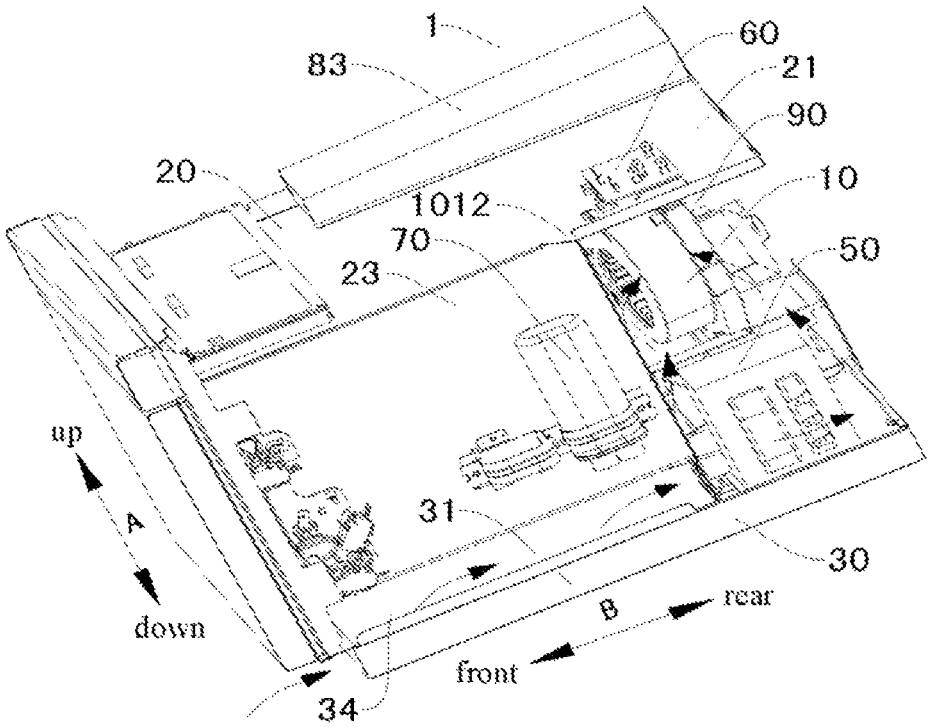
FIG. 7 is a schematic partial view of a microwave oven according to an embodiment of the present invention.

As shown in FIG. 7, the cooling air inlet 34 of the microwave oven 1 is formed in the bottom plate 31 of the shell 30, and located between the side plate (not shown) of the shell 30 and the side plate 23 of the compartment 20.

The microwave oven 1 further includes a fourth electric member 70 (e.g., a high-voltage capacitor) located between the side plate of the shell 30 and the side plate 23 of the compartment 20. A part of cold air from the cooling air inlet 34 of the microwave oven 1 may be used to cool the fourth electric member 70.

Figure 10:
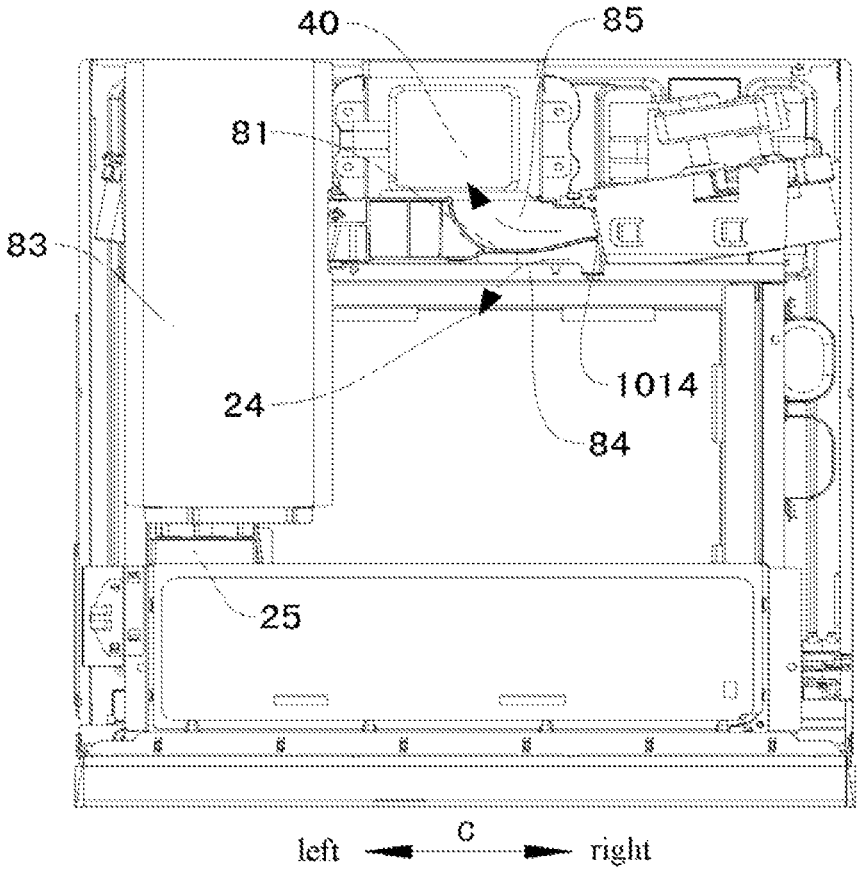
FIG. 10 is a schematic partial view of a microwave oven according to an embodiment of the present invention.
Figure 11:
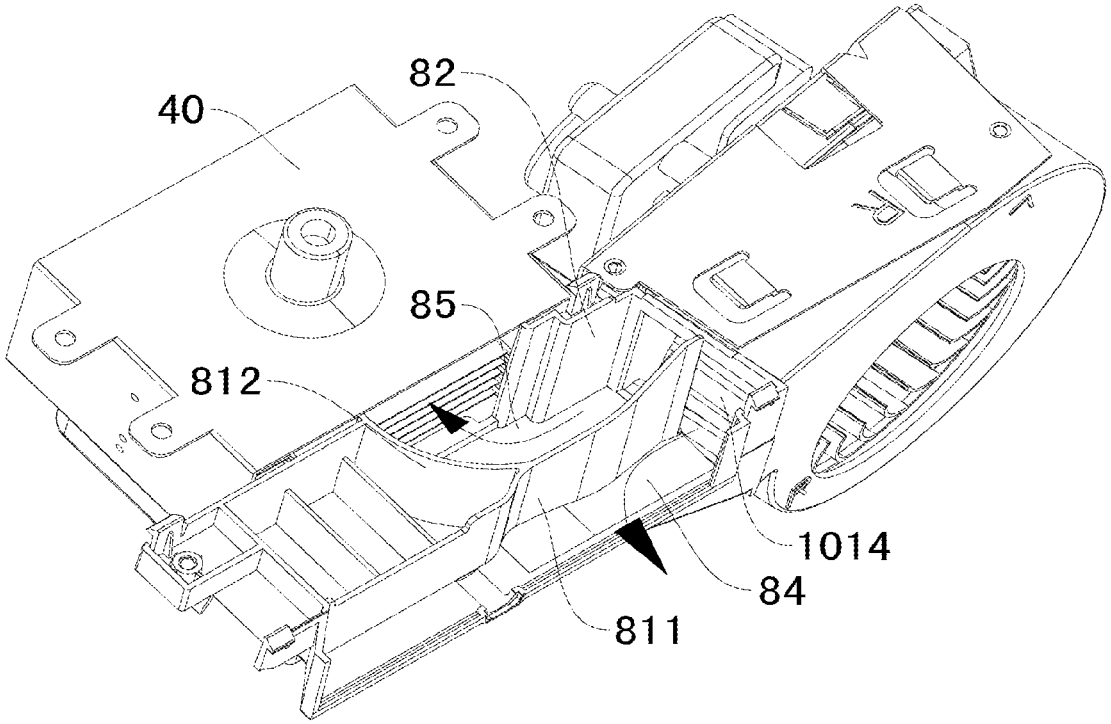
FIG. 11 is a schematic partial view of a microwave oven according to an embodiment of the present invention.

As shown in FIGS. 10-11, in some examples, the microwave oven 1 further includes a front air guiding plate 81, an end of the front air guiding plate 81 is adjacent to and opposite to the first air outlet 1014, and the front air guiding plate 81 extends in a direction away from the first air outlet 1014.

A first air duct 84 is formed between the front air guiding plate 81 and the rear plate 22 of the compartment 20, and the rear plate 22 of the compartment 20 is located in front of the front air guiding plate 81. A second air duct 85 is formed behind the front air guiding plate 81 and opposite to the first electric member 40. In other words, the front air guiding plate 81 may divide cold air blown from the first air outlet 1014 into two cold air streams, one cold air stream flows along the first air duct 84, and the other cold air stream flows along the second air duct 85 and is used to cool the first electric member 40.

A compartment air inlet 24 is formed in the rear plate 22 of the compartment 20 and communicated with the first air duct 84, and a compartment air outlet 25 is formed in the compartment 20. Cold air flowing along the first air duct 84 enters the cavity of the compartment 20 via the compartment air inlet 24, and leaves the cavity of the compartment 20 via the compartment air outlet 25.

Therefore, cold air blown from the first air outlet 1014 may be used to cool the first electric member 40 and the cavity of the compartment 20 simultaneously and respectively, thus dissipating heat from the microwave oven 1 in a three-dimensional way and further enhancing the heat dissipation effect of the microwave oven 1.

Figure 8:
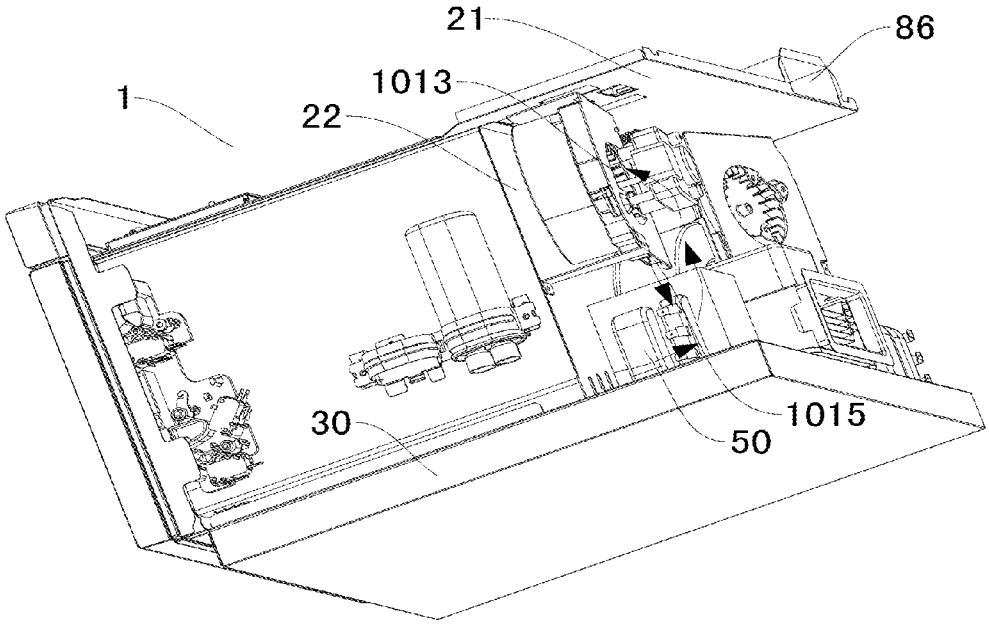
FIG. 8 is a schematic partial view of a microwave oven according to an embodiment of the present invention.
Figure 9:
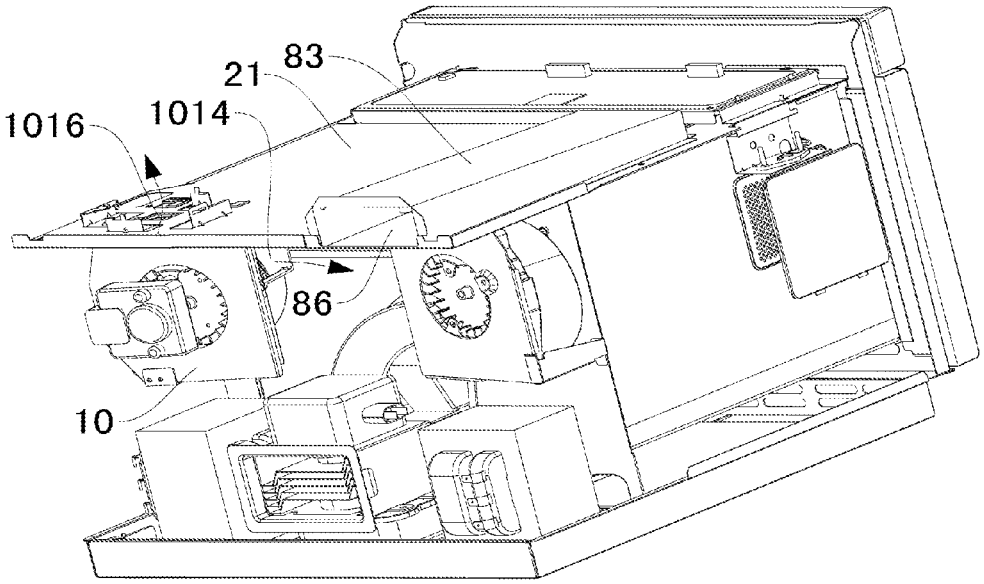
FIG. 9 is a schematic partial view of a microwave oven according to an embodiment of the present invention.

Advantageously, the compartment air outlet 25 is formed in a top plate 21 of the compartment 20. As shown in FIGS. 7-9, the microwave oven 1 further includes an air guiding shield 83 disposed on the top plate 21 of the compartment 20, and a third air duct 86 is formed between the air guiding shield 83 and the top plate 21 of the compartment 20 and extends in a front-rear direction. A front part of the third air duct 86 is communicated with the compartment air outlet 25. Thus, air leaving the cavity of the compartment 20 via the compartment air outlet 25 may flow along the third air duct 86, and finally is discharged out of the microwave oven 1 from the cooling air outlet in the shell 30. Thus, the microwave oven 1 may have a more reasonable structure.

The front-rear direction is as indicated by an arrow B in FIG. 7, and the left-right direction is as indicated by an arrow C in FIG. 10.

As shown in FIG. 11, in an example, the microwave oven 1 further includes a rear air guiding plate 82, an end of the rear air guiding plate 82 is adjacent to the first air outlet 1014, the rear air guiding plate 82 extends in the direction away from the first air outlet 1014, and the second air duct 85 is formed between the front air guiding plate 81 and the rear air guiding plate 82. Thus, more cold air may flow along the second air duct 85, thus further enhancing the cooling effect of the first electric member 40.

Advantageously, as shown in FIG. 11, the rear air guiding plate 82 is located behind the first air outlet 1014, and adjacent to the first air outlet 1014 in the front-rear direction. Thus, it is possible to adjust the volume of cold air blown to the first electric member 40 and the volume of cold air blown into the cavity of the compartment 20 by moving the front air guiding plate 81 in the front-rear direction.

An end of the front air guiding plate 81 may be connected with an edge of the first air outlet 1014, i.e. the end of the front air guiding plate 81 may be connected with the fan 10, and an end of the rear air guiding plate 82 may be connected with the fan 10. Advantageously, the end of the front air guiding plate 81 is located in a middle of the first air outlet 1014 in the front-rear direction, such that the volume of cold air blown to the first electric member 40 is substantially equal to the volume of cold air blown into the cavity of the compartment 20.

As shown in FIG. 11, in a specific example, the front air guiding plate 81 includes an air guiding plate body 811 and an arc-shaped plate 812. An end of the air guiding plate body 811 is adjacent to and opposite to the first air outlet 1014. The air guiding plate body 811 extends in the left-right direction, and the first air duct 84 is formed between the air guiding plate body 811 and the rear plate 22 of the compartment 20. A front end of the arc-shaped plate 812 is connected with the air guiding plate body 811, and the arc-shaped plate 812 extends backward from the air guiding plate body 811, and the second air duct 85 is formed between the air guiding plate body 811, the arc-shaped plate 812 and the rear air guiding plate 82.

By providing the arc-shaped plate 812, the flowing direction of cold air flowing along the second air duct 85 may be adjusted gradually, so as to cool the first electric member 40 more effectively. Advantageously, the air guiding plate body 811, the arc-shaped plate 812 and the rear air guiding plate 82 may be provided substantially vertically.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present invention. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention.

What is claimed is:

1. A microwave oven, comprising:

a shell defining a cooling air inlet and a cooling air outlet therein;

a compartment defining a cavity, nested in the shell and defining an open front end, a receiving space being defined between a rear plate of the compartment and a rear plate of the shell, an air intake duct being formed between a side plate of the shell and a side plate of the compartment and communicated with the cooling air inlet;

a first electric member and a second electric member disposed in the receiving space respectively; and a fan disposed in the receiving space, defining a first air inlet, a second air inlet opposite to the first air inlet, a first air outlet communicated with the first air inlet to define a first air blowing channel, and a second air outlet communicated with the second air inlet to define a second air blowing channel, the first air blowing channel being disposed independently of the second air blowing channel, the fan being configured to cool the first electric member via the first air blowing channel and to cool the second electric member via the second air blowing channel;

a compartment air inlet formed in the rear plate of the compartment, a compartment air outlet formed in the compartment, and wherein the microwave oven further comprises a front air guiding plate defining an end adjacent to and opposite to the first air outlet, and extending in a direction away from the first air outlet, a first air duct is formed between the front air guiding plate and the rear plate of the compartment and communicated with the compartment air inlet, and a second air duct is formed behind the front air guiding plate and opposite to the first electric member.

2. The microwave oven according to claim 1, wherein the fan further comprises a third air outlet, an opening direction of the third air outlet is different from the opening direction of the first air outlet and the opening direction of the second air outlet, the second air inlet is communicated with the third air outlet to define a third air blowing channel, and the microwave oven further comprises a third electric member, and the fan is configured to cool the third electric member via the third air blowing channel.

3. The microwave oven according to claim 2, wherein an opening of the first air outlet faces leftward or rightward, the first electric member is located at a left side or a right side of the first air outlet, an opening of the second air outlet faces downward, the second electric member is located below the second air outlet, an opening of the third air outlet faces upward, and the third electric member is located above the third air outlet.

4. The microwave oven according to claim 3, wherein the second electric member is disposed on a bottom plate of the shell, a part of a top plate of the compartment is backward extended beyond the rear plate of the compartment, and the third electric member is disposed on the part of the top plate of the compartment.

5. The microwave oven according to claim 1, further comprising:

a rear air guiding plate defining an end adjacent to the first air outlet, and extending in the direction away from the first air outlet, the second air duct being formed between the front air guiding plate and the rear air guiding plate.

6. The microwave oven according to claim 5, wherein the front air guiding plate comprises:

an air guiding plate body extending in a left-right direction, the first air duct being formed between the air guiding plate body and the rear plate of the compartment; and an arc-shaped plate defining a front end connected with the air guiding plate body, and extending backward from the air guiding plate body, the second air duct being formed between the air guiding plate body, the arc-shaped plate and the rear air guiding plate.

7. The microwave oven according to claim 1, wherein the compartment air outlet is formed in a top plate of the compartment, the microwave oven further comprises an air guiding shield disposed on the top plate of the compartment, a third air duct is formed between the air guiding shield and the top plate of the compartment and extends in a front-rear direction, and a front part of the third air duct is communicated with the compartment air outlet.

8. The microwave oven according to claim 2, wherein the cooling air inlet is formed in a bottom plate of the shell, and located between the side plate of the shell and the side plate of the compartment, and the microwave oven further comprises a fourth electric member located between the side plate of the shell and the side plate of the compartment.

9. The microwave oven according to claim 8, wherein the first electric member is a magnetron, the second electric member is a transformer, the third electric member is a filter board, and the fourth electric member is a high-voltage capacitor.

* * * * *